US008186360B2

(12) United States Patent
Marshall et al.

(10) Patent No.: US 8,186,360 B2
(45) Date of Patent: May 29, 2012

(54) CIGARETTE COMPRISING DARK AIR-CURED TOBACCO

(75) Inventors: Jerry Wayne Marshall, Stokesdale, NC (US); Susan Marlene Adams, Pine Hall, NC (US); Dwayne William Beeson, Kernersville, NC (US); Ernest L. Cerny, III, Clemmons, NC (US); Keisha Renee Willingham, Rural Hall, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1073 days.

(21) Appl. No.: 11/696,416

(22) Filed: Apr. 4, 2007

(65) Prior Publication Data

US 2008/0245377 A1 Oct. 9, 2008

(51) Int. Cl.
*A24D 3/14* (2006.01)

(52) U.S. Cl. ..... 131/332; 131/331

(58) Field of Classification Search ..... 131/332, 131/341

See application file for complete search history.

(56) References Cited

U.S. PATENT DOCUMENTS

| | | | | |
|---|---|---|---|---|
| 2,881,770 | A | | 4/1959 | Touey |
| 3,067,068 | A | * | 12/1962 | Finberg ..... 131/359 |
| 3,101,723 | A | | 8/1963 | Seligman et al. |
| 3,217,715 | A | | 11/1965 | Berger, et al. |
| 3,236,244 | A | | 2/1966 | Irby, Jr. et al. |
| 3,311,519 | A | | 3/1967 | Touey et al. |
| 3,347,247 | A | | 10/1967 | Lloyd |
| 3,349,780 | A | | 10/1967 | Sublett et al. |
| 3,370,595 | A | | 2/1968 | Davis et al. |
| 3,413,982 | A | | 12/1968 | Sublett et al. |
| 3,424,172 | A | | 1/1969 | Neurath |
| 3,602,231 | A | | 8/1971 | Dock |
| 3,648,711 | A | | 3/1972 | Berger et al. |
| 3,957,563 | A | | 5/1976 | Sexstone |
| 3,972,335 | A | | 8/1976 | Tiggelbeck et al. |
| 4,174,720 | A | | 11/1979 | Hall |
| 4,201,234 | A | | 5/1980 | Neukomm |
| 4,223,597 | A | | 9/1980 | Lebet |
| 4,771,795 | A | | 9/1988 | White et al. |

(Continued)

FOREIGN PATENT DOCUMENTS

EP 0 419 733 A2 4/1991

(Continued)

OTHER PUBLICATIONS

Bombick et al., "Evaluation of the Genotoxic and Cytotoxic Potential of Mainstream Whole Smoke and Smoke Condensate from a Cigarette Containing a Novel Carbon Filter", *Fundamental and Applied Toxicology*, 1997, pp. 11-17, vol. 39.

(Continued)

*Primary Examiner* — Philip Tucker
*Assistant Examiner* — Vicki Wu
(74) *Attorney, Agent, or Firm* — Womble Carlyle Sandridge & Rice, LLP

(57) ABSTRACT

A cigarette is provided that includes a rod of smokable material circumscribed by an outer wrapping material and a filter element, which may include an adsorbent material such as activated carbon, attached to one end of the rod of smokable material. The smokable material includes at least about 5 percent by weight of a dark air-cured tobacco, based on the dry weight of the smokable material, blended with additional tobacco materials such as flue-cured tobacco, burley tobacco, Oriental tobacco, Maryland tobacco, and mixtures thereof.

19 Claims, 2 Drawing Sheets

U.S. PATENT DOCUMENTS

| | | | | |
|---|---|---|---|---|
| 4,811,745 | A | 3/1989 | Cohen et al. | |
| 4,819,668 | A | 4/1989 | Shelar et al. | |
| 4,836,224 | A | 6/1989 | Lawson et al. | |
| 4,924,883 | A | 5/1990 | Perfetti et al. | |
| 4,924,888 | A | 5/1990 | Perfetti et al. | |
| 4,925,602 | A | 5/1990 | Hill et al. | |
| 5,027,837 | A | 7/1991 | Clearman et al. | |
| 5,056,537 | A | 10/1991 | Brown et al. | |
| 5,137,034 | A | 8/1992 | Perfetti et al. | |
| 5,159,942 | A | 11/1992 | Brinkley et al. | |
| 5,220,930 | A | 6/1993 | Gentry | |
| 5,225,277 | A | 7/1993 | Takegawa et al. | |
| 5,271,419 | A | 12/1993 | Arzonico et al. | |
| 5,360,023 | A | 11/1994 | Blakley et al. | |
| 5,387,285 | A | 2/1995 | Rivers | |
| 5,568,819 | A | 10/1996 | Gentry et al. | |
| 5,622,190 | A | 4/1997 | Arterbery et al. | |
| 5,714,844 | A | 2/1998 | Sato | |
| 6,537,186 | B1 | 3/2003 | Veluz | |
| 6,584,979 | B2 | 7/2003 | Xue et al. | |
| 6,701,936 | B2 | 3/2004 | Shafer et al. | |
| 6,730,832 | B1 | 5/2004 | Dominguez et al. | |
| 6,761,174 | B2 | 7/2004 | Jupe et al. | |
| 6,789,547 | B1 | 9/2004 | Paine, III | |
| 6,789,548 | B2 | 9/2004 | Bereman | |
| 6,846,177 | B1 * | 1/2005 | Hutchens | 131/290 |
| 2002/0020420 | A1 | 2/2002 | Xue et al. | |
| 2002/0166563 | A1 | 11/2002 | Jupe et al. | |
| 2003/0075193 | A1 | 4/2003 | Li et al. | |
| 2003/0131859 | A1 | 7/2003 | Li et al. | |
| 2003/0154993 | A1 | 8/2003 | Paine, III et al. | |
| 2003/0168070 | A1 | 9/2003 | Xue et al. | |
| 2003/0200973 | A1 | 10/2003 | Xue et al. | |
| 2004/0084056 | A1 | 5/2004 | Lawson et al. | |
| 2004/0173228 | A1 | 9/2004 | Coleman, III | |
| 2004/0194792 | A1 | 10/2004 | Zhuang et al. | |
| 2004/0226569 | A1 | 11/2004 | Yang et al. | |
| 2004/0237984 | A1 | 12/2004 | Figlar et al. | |
| 2004/0255965 | A1 | 12/2004 | Perfetti et al. | |
| 2005/0039767 | A1 * | 2/2005 | Mua et al. | 131/370 |
| 2005/0049128 | A1 | 3/2005 | Buhl et al. | |
| 2005/0066980 | A1 * | 3/2005 | Crooks et al. | 131/341 |
| 2005/0066982 | A1 | 3/2005 | Clark et al. | |
| 2005/0066984 | A1 * | 3/2005 | Crooks et al. | 131/341 |
| 2005/0066986 | A1 | 3/2005 | Nestor et al. | |
| 2005/0133051 | A1 | 6/2005 | Luan et al. | |
| 2005/0268925 | A1 | 12/2005 | Schluter et al. | |
| 2006/0130861 | A1 | 6/2006 | Luan et al. | |
| 2006/0144410 | A1 | 7/2006 | Luan et al. | |
| 2006/0174899 | A9 | 8/2006 | Luan et al. | |
| 2006/0180164 | A1 | 8/2006 | Paine, III et al. | |
| 2006/0293157 | A1 | 12/2006 | Deal | |
| 2007/0056600 | A1 * | 3/2007 | Coleman et al. | 131/332 |
| 2008/0173320 | A1 * | 7/2008 | Dunlap et al. | 131/365 |

FOREIGN PATENT DOCUMENTS

| | | | |
|---|---|---|---|
| EP | 0 419 981 | A2 | 4/1991 |
| EP | 0 579 410 | A1 | 1/1994 |
| WO | WO 02/37990 | A2 | 5/2002 |
| WO | WO 03/059096 | A1 | 7/2003 |
| WO | WO 2006/051422 | A1 | 5/2006 |
| WO | WO 2006/064371 | A1 | 6/2006 |

OTHER PUBLICATIONS

Campbell, John S., "Tobacco and the Environment: The Continuous Reduction of Worldwide Energy Source Use for Green Leaf Curing", *Beiträge zur Tabakforschung International*, 1995, pp. 107-117, vol. 16. No. 3.

Davis et al., *Tobacco Production, Chemistry and Technology*, 1999, pp. 440-460, Blackwell Science, Inc., Malden, MA.

* cited by examiner

CIGARETTE COMPRISING DARK AIR-CURED TOBACCO

FIELD OF THE INVENTION

The present invention relates to tobacco products, such as smoking articles (e.g., cigarettes), and in particular, to filtered cigarettes.

BACKGROUND OF THE INVENTION

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Typically, tobacco materials are used in blended form. For example, certain popular tobacco blends, commonly referred to as "American" blends, comprise mixtures of flue-cured tobacco, burley tobacco and Oriental tobacco. Such blends, in many cases, contain tobacco materials that have processed forms, such as processed tobacco stems (e.g., cut-rolled stems, cut-rolled-expanded stems or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). Tobacco reconstitution processes traditionally convert portions of tobacco that normally might be wasted into commercially useful forms. For example, tobacco stems, recyclable pieces of tobacco and tobacco dust can be used to manufacture processed reconstituted tobaccos of fairly uniform consistency. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999). Various representative tobacco types, processed types of tobaccos, types of tobacco blends, cigarette components and ingredients, and tobacco rod configurations, also are set forth in U.S. Pat. Nos. 4,836,224 to Lawson et al.; 4,924,883 to Perfetti et al.; 4,924,888 to Perfetti et al.; 5,056,537 to Brown et al.; 5,159,942 to Brinkley et al.; 5,220,930 to Gentry; 5,360,023 to Blakley et al.; 5,714,844 to Young et al.; 6,730,832 to Dominguez et al.; and 6,701,936 to Shafer et al.; U.S. Patent Application Publication Nos. 2003/0075193 to Li et al.; 2003/0131859 to Li et al.; 2004/0084056 to Lawson et al.; 2004/0255965 to Perfetti et al.; 2005/0066984 to Crooks et al.; and 2005/0066986 to Nestor et al.; PCT WO 02/37990 to Bereman; and Bombick et al., Fund. Appl. Toxicol., 39, p. 11-17 (1997); which are incorporated herein by reference.

Dark air-cured tobacco is a type of tobacco used mainly for chewing tobacco, snuff, cigars, and pipe blends. Most of the world production of such tobacco is confined to the tropics; however, sources of dark air-cured tobacco are also found in Kentucky, Tennessee, and Virginia. Dark air-cured tobacco plants are characterized by leaves with a relatively heavy body and such tobacco plants are typically highly fertilized and topped low to around 10-12 leaves. See Tobacco Production, Chemistry and Technology, Davis et al. (Eds.) pp. 440-451 (1999).

The design and content of the tobacco rod and the design and content of the filter element affect the organoleptic properties of the cigarette. Various combinations of tobacco materials, flavorants, and filtration media can produce widely varying sensory characteristics. There is a continuing need in the art for cigarette configurations and designs that provide enjoyable sensory characteristics. In particular, as cigarettes utilizing adsorbent materials in the filter element become more prevalent, there is a continuing need to counteract any negative impact that such filter designs may have on the organoleptic properties of the cigarette. Thus, it would be highly desirable to provide a cigarette possessing a filter element incorporating an adsorbent (e.g., a carbonaceous material) that combines the ability to efficiently remove effective amounts of various gas phase components of mainstream tobacco smoke passing through that filter element, and the ability to produce mainstream tobacco smoke possessing desired sensory characteristics after passing through the filter element.

SUMMARY OF THE INVENTION

The invention provides cigarettes and other smoking articles, particularly those smoking articles including filter elements, wherein the rod of smokable material includes dark air-cured tobacco within a tobacco blend, which imparts unique organoleptic characteristics to the smoking article and which can serve as a substitute for burley tobacco since both dark air-cured tobacco and burley tobacco produce bitter taste sensations. The resulting tobacco blend can be less costly to produce while still providing a desirable sensory experience. Additionally, dark air-cured tobacco has been shown to enhance the organoleptic properties of smoking articles incorporating flavorants, such as menthol, and smoking articles comprising activated carbon or other adsorbent materials in the filter element.

In one embodiment, the invention provides a cigarette comprising a rod of smokable material circumscribed by an outer wrapping material, wherein the smokable material comprises a blend of tobacco materials, wherein the blend comprises at least about 5 percent by weight of a dark air-cured tobacco, based on the dry weight of the smokable material. The dark air-cured tobacco is typically present in an amount of about 5 to about 15 percent by weight, more preferably about 5 to about 10 percent by weight. Exemplary types of dark air-cured tobacco include Sumatra, Jatim, Dominican Cubano, Besuki, One sucker, Green River, Virginia sun-cured, and Paraguan Passado. The dark air-cured tobacco utilized in the invention can be produced in various parts of the world, including Central America, South America, India, Indonesia, Philippines, Canada, United States, Caribbean Basin, and Africa.

The smokable material typically comprises a blend of the dark air-cured tobacco with flue-cured tobacco, burley tobacco, Oriental tobacco, or mixtures thereof. In one embodiment, the smokable material comprises a blend of the dark air-cured tobacco with flue-cured tobacco in cut filler form, the flue-cured tobacco being present in an amount of at least about 80 percent by weight. In another embodiment, the smokable material comprises a blend of the dark air-cured tobacco with Oriental tobacco in cut filler form, the Oriental tobacco being present in an amount of at least about 50 percent by weight. In certain embodiments, burley tobacco is present in an amount of no more than about 8 percent by weight. The cigarette of the invention may further include flavorants such as menthol.

In another aspect of the invention, the cigarette includes a filter element attached to one end of the rod of smokable material, and in particular, the filter element can include an adsorbent material such as activated carbon, molecular sieves, clays, ion exchange resins, activated aluminas, silica gels, meerschaum, or mixtures thereof. For example, in one embodiment, the cigarette of the invention comprises a rod of smokable material circumscribed by an outer wrapping material and a filter element comprising an adsorbent material attached to one end of the rod of smokable material, wherein the smokable material comprises at least about 5 percent by weight of a dark air-cured tobacco, based on the dry weight of the smokable material, blended with additional tobacco materials selected from the group consisting of flue-cured tobacco, burley tobacco, Oriental tobacco, Maryland tobacco, and mixtures thereof.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

The present inventions now will be described more fully hereinafter with reference to the accompanying drawing. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

Smoking Article of the Invention

Figure 1:
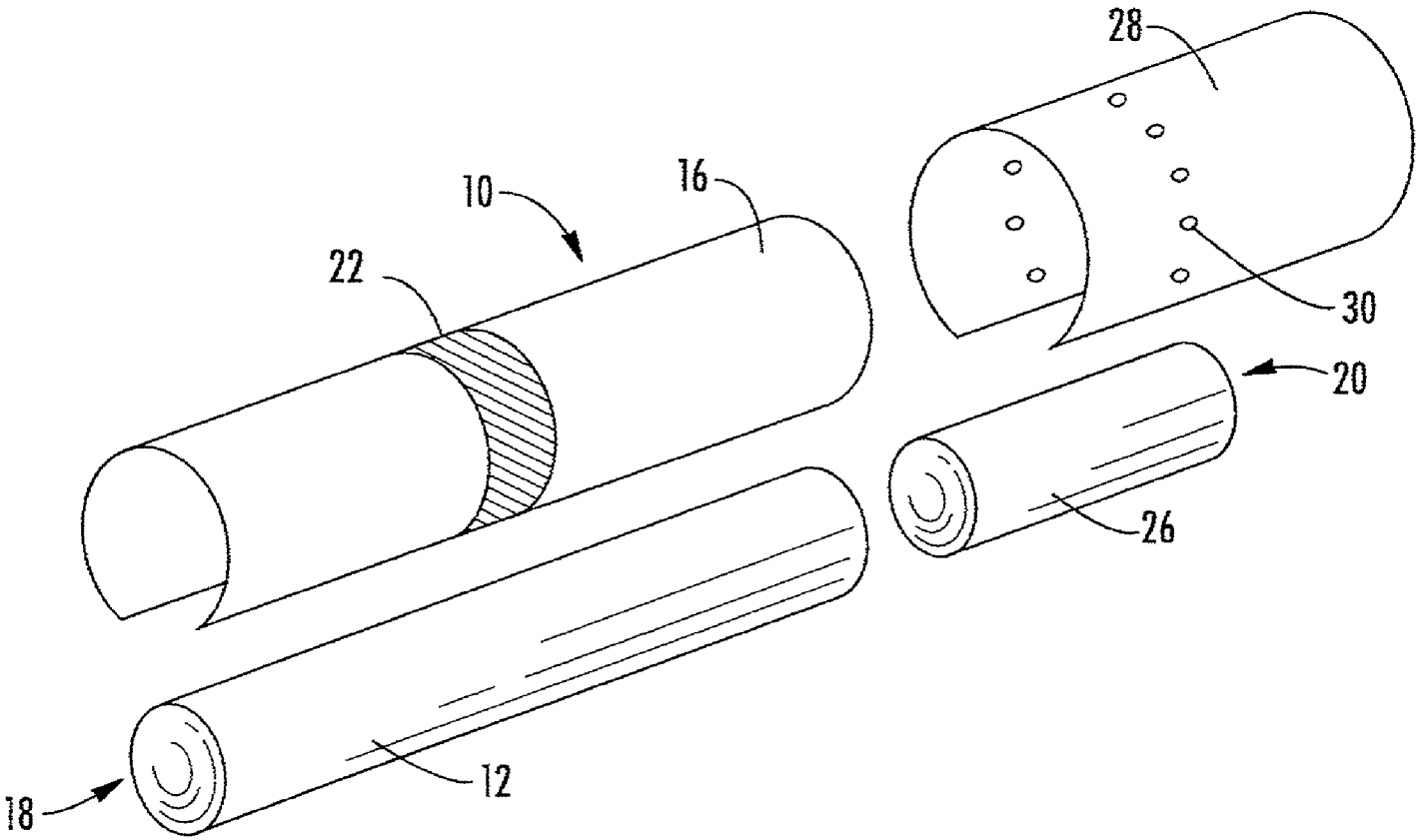
Fig. 1 PRIOR ART
FIG. 1 is an exploded perspective view of one embodiment of a smoking article according to the invention having the form of a cigarette, showing the smokable material, the wrapping material components, and the filter element of the cigarette.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 is positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. The filter element 26 is circumscribed along its outer circumference or longitudinal periphery by a layer of outer plug wrap 28.

Figure 2:
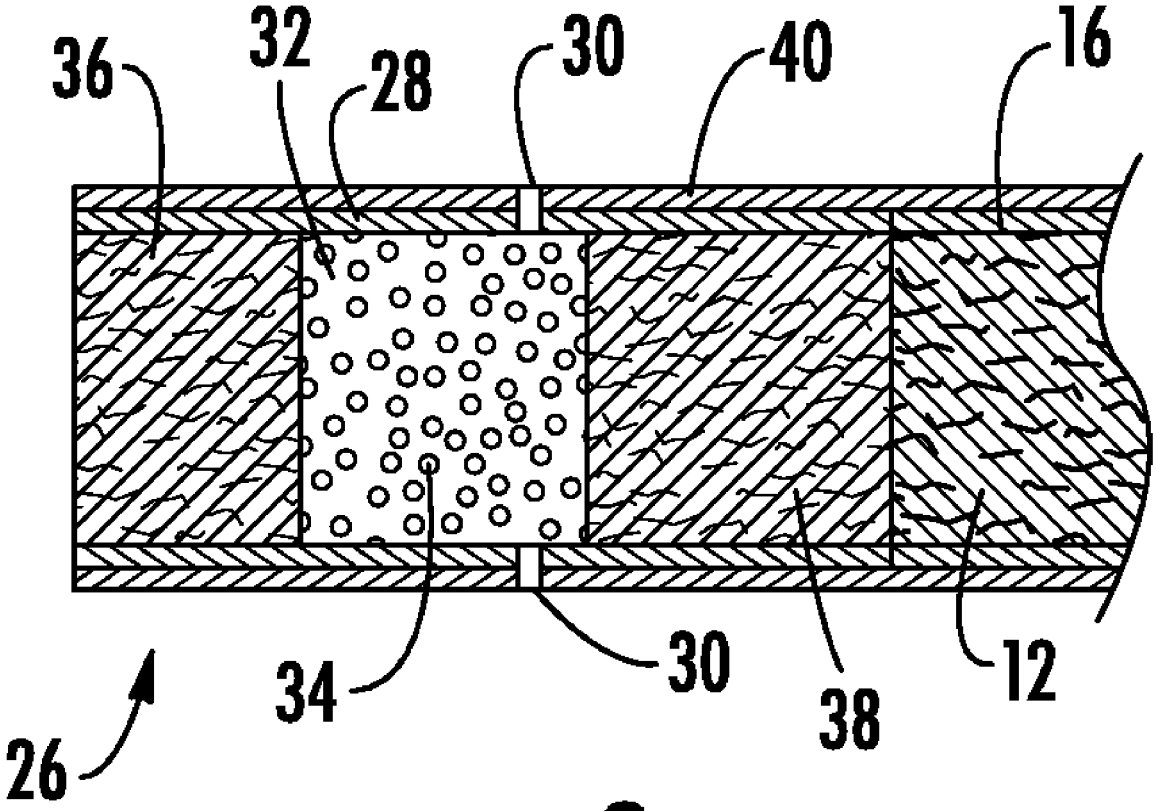
FIG. 2 is a cross-sectional view of one embodiment of a filter element according to the invention comprising an adsorbent material.

A ventilated or air diluted smoking article can be provided with an optional air dilution means, such as a series of perforations 30, each of which extend through the tipping material 40 (as shown in FIG. 2) and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

As shown in FIG. 2, the filter element 26 is attached to the tobacco rod 12 using tipping material 40 (e.g., essentially air impermeable tipping paper), that circumscribes both the entire length of the filter element 26 and an adjacent region of the tobacco rod 12. The inner surface of the tipping material 40 is fixedly secured to the outer surface of the plug wrap 28 and the outer surface of the wrapping material 16 of the tobacco rod, using a suitable adhesive; and hence, the filter element and the tobacco rod are connected to one another.

The plug wrap 28 can vary. See, for example, U.S. Pat. No. 4,174,719 to Martin. Typically, the plug wrap is a porous or non-porous paper material. Plug wrap materials are commercially available. Exemplary porous plug wrap papers are available from Schweitzer-Maudit International as Porowrap Plug Wrap 17-M1, 33-M1, 45-M1, 65-M9, 95-M9, 150-M4, 260-M4 and 260-M4T. Non-porous plug wraps exhibit porosities of less than about 10 CORESTA units, and preferably less than about 5 CORESTA units. Exemplary non-porous plug wrap papers are available as Ref. No. 646 Grade from Olsany Facility (OP Paprina) of the Czech Republic (Trierenberg Holding). Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

The outer wrapping material 16 of the tobacco rod 12 can have a wide range of compositions and properties. The selection of a particular wrapping material will be readily apparent to those skilled in the art of cigarette design and manufacture. Preferably, the outer wrapping material is a paper material, such as the type of paper material typically used in cigarette manufacture. The outer wrapping material can be composed of materials, or be suitably treated, in order that the wrapping material does not experience a visible staining as a result of contact with components of the smokable material (e.g., aerosol forming material). The porosity of the wrapping material can vary, and frequently is between about 5 CORESTA units and about 100 CORESTA units, often is between about 10 CORESTA units and about 90 CORESTA units, and frequently is between about 20 CORESTA units and about 80 CORESTA units. Exemplary types of wrapping materials, wrapping material components and treated wrapping materials are described in U.S. Pat. Nos. 5,105,838 to White et al.; 5,271,419 to Arzonico et al.; 5,220,930 to Gentry; 6,874,508 to Shafer et al.; and 6,908,874 to Woodhead et al.; U.S. Pat. Application Publication Nos. 2004/0134631 to Crooks et al.; 2005/0005947 to Hampl, Jr. et al.; 2005/0005947 to Hampl, Jr. et al.; 2005/0016556 to Ashcraft et al.; and 2005/0076929 to Fitzgerald et al.; PCT WO 01/08514 to Fournier et al.; WO 03/043450 to Hajaligol et al.; and WO 2005/039326 to Rasouli et al.; which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Maudit International. Colored wrapping materials (e.g., brown colored papers) can be employed.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the tobacco rod 12, through the filter element 26, and into the mouth of the smoker.

The dimensions of a representative cigarette 10 can vary. Preferred cigarettes are rod shaped, and can have a diameter of about 7.5 mm (e.g., a circumference of about 20 mm to about 27 mm, often about 22.5 mm to about 25 mm); and can have a total length of about 70 mm to about 120 mm, often about 80 mm to about 100 mm. The length of the filter element 26 can vary. Typical filter elements can have lengths of about 15 mm to about 65 mm, often about 20 mm to about 40 mm.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available from Filtrona Instruments and Automation Ltd. or a Quality Test Module (QTM) available from the Cerulean Division of Molins, PLC.

Cigarettes of the present invention, when smoked, yield an acceptable number of puffs. Such cigarettes normally provide more than about 6 puffs, and generally more than about 8 puffs, per cigarette, when machine smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder.

Cigarettes of the present invention, when smoked, yield mainstream aerosol. The amount of mainstream aerosol that is yielded per cigarette can vary. When smoked under FTC smoking conditions, an exemplary cigarette yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 20 mg, often does not exceed about 15 mg, and frequently does not exceed about 12 mg.

Smokable Filler Material

The smokable materials used in the tobacco rod 12 of the smoking article 10 of the invention are typically composed predominantly of tobacco of some form, based on the dry weights of those materials. That is, the majority of the dry weight of those materials, and the majority of the weight of a mixture incorporating those materials (including a blend of materials, or materials having additives applied thereto or otherwise incorporated therein) can be provided by tobacco of some form. For example, those materials can be processed tobaccos that incorporate minor amounts of non-tobacco filler materials (e.g., calcium carbonate particles, carbonaceous materials, grains or wood pulp) and/or binding agents (e.g., guar gum, sodium alginate or ammonium alginate); and/or a blend of those materials can incorporate tobacco substitutes or extenders. Those materials, and blends incorporating those materials, frequently are composed of greater than about 70 percent tobacco, often are greater than about 80 percent tobacco, and generally are greater than about 90 percent tobacco, on a dry weight basis, based on the combined weights of the tobacco, non-tobacco filler material, and non-tobacco substitute or extender. Those materials also can be composed of virtually all tobacco material, and not incorporate any non-tobacco fillers, substitutes, or extenders.

Smokable materials typically are used in forms, and in manners, that are traditional for the manufacture of smoking articles, such as cigarettes. Those materials can incorporate shredded or particulate pieces of tobacco (e.g., as lamina and/or stem), and/or those materials can be tobacco materials that are in processed forms. For example, those materials normally are used in cut filler form (e.g., shreds or strands of tobacco filler cut into widths of about 1/10 inch to about 1/60 inch, preferably about 1/20 inch to about 1/35 inch, and in lengths of about 1/8 inch to about 3 inches, usually about 1/4 inch to about 1 inch). Alternatively, though less preferred, those materials, such as processed tobacco materials, can be employed as longitudinally extending strands or as sheets formed into the desired configuration, or as compressed or extruded pieces formed into a desired shape.

Tobacco materials can include, or can be derived from, various types of tobaccos, such as flue-cured tobacco, burley tobacco, Oriental tobacco, Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in Tobacco Production, Chemistry and Technology, Davis et al. (Eds.) (1999). See, also, U.S. Pat. Application Publication No. 2004/0084056 to Lawson et al. Most preferably, the tobacco materials are those that have been appropriately cured and aged.

The smokable filler material of the invention includes dark air-cured tobacco in an amount sufficient to alter the sensory characteristics of the smoking article. Dark air-cured tobacco is a defined class of tobacco understood in the art to refer to tobacco materials that are cured in ambient environments generally without the application of heat from sources other than the sun, and includes dark sun-cured tobacco material. Dark air-cured tobacco is grown in various regions of the world, including North America, Caribbean Basin, Central America, South America, Asia, and in the South Pacific. Exemplary countries wherein dark air-cured tobacco varieties originate include Brazil, Argentina, Guatemala, Dominican Republic, Canada, United States, Indonesia (e.g., Java), India, South Africa, and Philippines. The three primary types of dark air-cured tobacco grown in the United States are Green River, Virginia sun-cured, and One sucker. Other specific types of dark air-cured tobacco available from sources outside the United States include Sumatra (Indonesia), Jatim (Indonesia), Piloto Cubano (Dominican Republic), Besuki (Indonesia), and Passado (Paraguay).

The present invention is based, in part, on the discovery that dark air-cured tobacco, which has been traditionally used only in cigars and smokeless tobacco products, can impart desirable sensory characteristics when incorporated into tobacco blends utilized in cigarettes. In particular, dark air-cured tobacco can be used as a substitute for burley tobacco, which is more costly, in certain tobacco blends. Dark air-cured tobacco produces bitter taste sensations similar to burley tobacco. Although the organoleptic properties of dark air-cured tobacco are unique and cannot be viewed as identical to the organoleptic properties of burley tobacco, the similarities are sufficient to allow dark air-cured tobacco to serve as a substitute for burley tobacco in certain tobacco blends. Thus, the inclusion of dark air-cured tobacco in cigarette tobacco blends can reduce cost of certain popular tobacco blends while presenting a unique and desirable organoleptic profile.

The unit aromas of certain dark air-cured tobaccos suitable for use in the invention can be described as including earthy, animalistic, fermented, and pungent elements that are slightly elevated as compared to other tobacco types. The mainstream sensory characteristics of certain dark air-cured tobacco suitable for use in the invention can be characterized by an increase in woody notes (Oak, Walnut and Cedar), wine-like taste attributes with elements of merlot and chardonnay, and an increase in dark notes (i.e., those perceived in the back of the mouth typical of some degree of bitterness as is found in chocolate). The perception of smoky notes is also slightly elevated. Smoke texture can be moved toward silky or husky depending on the type of dark air-cured tobacco utilized.

In particular, it is believed that unique and desirable sensory characteristics can be produced by using American, Virginia, or Oriental tobacco blends modified to include dark air-cured tobacco, particularly where the dark air-cured tobacco serves as a substitute for at least a portion of the burley tobacco that would normally be used. For purposes of this invention, an American tobacco blend is defined as a blend comprising flue-cured tobacco, burley tobacco, and Oriental tobacco, wherein the flue-cured tobacco is the predominate tobacco type and present at a concentration of at least 45 percent by weight (including cut filler and processed forms of flue-cured tobacco), based on the dry weight of the smokable material, and the Oriental and burley tobaccos are each present in an amount of at least about 8 percent by weight in cut filler form. Virginia blends are defined as blends comprising at least about 80 percent by weight of flue-cured tobacco in the form of cut filler, based on the dry weight of the smokable material. Oriental blends are defined as blends comprising at least about 50 percent by weight of Oriental tobacco in the form of cut filler, based on the dry weight of the smokable material.

In the present invention, the dark air-cured tobacco is present in an amount of at least about 5 percent by weight, based on dry weight of the smokable material, in a tobacco blend, such as a modified American, Virginia, or Oriental blend. In certain embodiments, the amount of dark air-cured tobacco in the tobacco blend is about 5 to about 15 percent by weight, preferably about 5 to about 10 percent by weight (e.g., about 5, about 6, about 7, about 8, about 9, or about 10 percent by weight). Typically, the amount of dark air-cured tobacco is offset by a reduction in the other blend strip components or the amount of burley tobacco utilized in the blend. In certain embodiments, the tobacco blend including the dark air-cured tobacco comprises no more than about 30 percent by weight of burley tobacco, and more preferably no more than about 8 percent by weight, and most preferably no more than about 4 percent by weight, based on the total dry weight of the smokable materials. Exemplary burley tobacco percentages by weight include about 1 to about 15 percent by weight, more preferably about 2 to about 8 percent by weight.

One exemplary tobacco blend for use in the present invention comprises about 10 to about 60 weight percent flue-cured tobacco in cut filler form, about 0 to about 45 weight percent burley tobacco in cut filler form, about 10 to about 60 weight percent Oriental tobacco in cut filler form, about 5 to about 15 weigh percent dark air-cured tobacco in cut filler form, about 20 to about 40 weight percent of processed forms of tobacco (e.g., reconstituted tobacco, expanded tobacco lamina, processed tobacco stems, and the like), and about 2 to about 10 weight percent of a casing material. Optionally, the blend may further include about 0 to about 3 weight percent of flavors in the form of a top dressing. A preferred top dressing composition comprises flavors with vapor pressures not exceeding about 2.0 mm Hg. at 40° C., such as menthol.

In another aspect, the invention provides cigarettes and other filtered smoking articles that include an adsorbent material, such as any of the adsorbent materials discussed herein (e.g., activated carbon), in the filter element, and which further include a smokable material that comprises dark air-cured tobacco. It has been discovered that the inclusion of dark air-cured tobacco in the tobacco blend can offset the negative effect of activated carbon on the sensory characteristics of the smoking article. Thus, inclusion of dark air-cured tobacco in a filtered cigarette comprising activated carbon or other adsorbent materials can provide enhanced organoleptic properties as compared to adsorbent-filtered cigarettes comprising blends with no dark air-cured tobacco. In particular, the charcoal taste associated with filtered cigarettes comprising a carbonaceous material in the filter can be significantly reduced or eliminated by inclusion of a dark air-cured tobacco in the tobacco blend according to the invention, as compared to conventional cigarette blends that do not contain dark air-cured tobacco.

In yet another aspect, the invention provides smoking articles that combine a flavorant such as menthol with a tobacco blend that includes dark air-cured tobacco according to the invention. The combination of menthol and dark air-cured tobacco has been shown to impart a unique and desirable sensory experience to the smoking article during smoking. Thus, combinations of menthol and other flavorants, which can be incorporated into the cigarette by conventional methods, with dark air-cured tobacco can produce cigarettes that exhibit desirable organoleptic characteristics.

The type of flue-cured tobacco used in smoking articles of the invention can vary. Descriptions of flue-cured tobaccos, growing practices, harvesting practices and curing practices are set forth in Hawks, *Principles of Flue-Cured Tobacco Production* (1978), Sumner et al., *Guidelines for Temperature, Humidity, and Airflow Control in Tobacco Curing*, Univ. Georgia Res. Bull. 299 (1983), Todd, *Flue-Cured Tobacco—Producing a Healthy Crop* (1981), *Tobacco Production, Chemistry and Technology*, Davis et al. (Eds.) (1999), *Flue-Cured Tobacco Information*, NC Coop. Ext. Serv. (2002) and US Pat. App. Pub. 2001/0000386 to Peele. Flue-cured tobaccos are also referred to as Virginia, bright or blond tobaccos. Representative flue-cured tobaccos include Coker 48, Coker 176, Coker 371-Gold, Coker 319, Coker 347, GL 939, K 149, K 326, K 340, K 346, K 358, K 394, K 399, K 730, NC 27NF, NC 37NF, NC 55, NC 60, NC 71, NC 72, NC 82, NC 95, NC 297, NC 606, NC 729, NC 2326, McNair 373, McNair 944, Ox 207, Ox 414 NF, Reams 126, Reams 713, Reams 744, RG 8, RG 11, RG 13, RG 17, RG 22, RG 81, RG H4, RG H51, Speight H-20, Speight G-28, Speight G-58, Speight G-70, Speight G-108, Speight G-111, Speight G-117, Speight 168, Speight 179, Speight NF-3, Va 116 and Va 182. Preferred flue-cured tobaccos are those that are cured using the types of techniques and conditions set forth in US Pat. App. Pub. 2001/0000386 to Peele. Preferred flue-cured tobaccos are aged for at least one year after curing is complete.

The type of burley tobacco utilized in the invention can vary. Descriptions of burley tobaccos, growing practices, harvesting practices and curing practices are set forth in Wiernik et al., *Rec. Adv. Tob. Sci*., Vol. 21, p. 39-80 (1995), *Tobacco Production, Chemistry and Technology*, Davis et al. (Eds.) (1999) and *Burley Tobacco Information*, NC Coop. Ext. Serv. (2002). Representative burley tobaccos include Clay 402, Clay 403, Clay 502, Ky 14, Ky 907, Ky 910, Ky 8959, NC 2, NC 3, NC 4, NC 5, NC 2000, Tn 86, Tn 90, Tn 97, R 610, R 630, R 711, R 712, NCBH 129, Bu 21×Ky 10, HB04P, Ky 14×L 8, Kt 200, Newton 98, Pedigo 561, Pf561 and Va 509. Preferred burley tobaccos are air cured. Preferred air cured burley tobaccos are aged for at least one year after curing is complete.

Oriental tobacco used in the invention can also vary. Descriptions of Oriental-type tobaccos, growing practices, harvesting practices and curing practices are set forth in Wolf, *Aromatic or Oriental Tobaccos* (1962), Akehurst, *Tobacco* (1968), *Tobacco Encyclopedia*, Voges (Ed.) (1984), *Tobacco Production, Chemistry and Technology*, Davis et al. (Eds.) (1999). Oriental-type tobaccos also are referred to as Greek, aromatic and Turkish tobaccos. Representative Oriental-type tobaccos include the Izmir, Basma, Mavra and Samsun varieties. Other representative Oriental-type tobaccos include Trabzon, Thesalian, Tasova, Sinop, Tzmit, Hendek, Edirne, Semdinli, Adiyanman, Yayladag, Iskenderun, Duzce, Macedonian, Katerini, Prilep, Krumovgrad, Bafra, Bursa, Bucak, Bitlis and Balikesir tobaccos, as well as the so-called semi-Oriental tobaccos such as Sebinkarahisar, Borgka and East Balkan tobaccos. Although Oriental-type tobaccos that are employed in accordance with the present invention can be grown in a variety of locations throughout the world, typical Oriental tobaccos are grown in eastern Mediterranean regions such as Turkey, Greece, Bulgaria, Macedonia, Syria, Lebanon, Italy, Yugoslavia, and Romania. Preferred Oriental tobaccos are sun-cured. Preferred sun cured Oriental tobaccos are aged for at least one year after curing is complete.

The type of Maryland tobacco used in the invention can vary. Descriptions of Maryland tobaccos, growing practices, harvesting practices and curing practices are set forth in *Tobacco Encyclopedia*, Voges (Ed.) (1984), Aycock et al., Maryland Coop. Ext. (1984), Aycock et al., Maryland Coop. Ext. (1995), *and Tobacco Production, Chemistry and Technology*, Davis et al. (Eds.) (1999). Representative Maryland tobaccos include Md 10, Md 40, Md 201, Md 609, Md 872 and Md 341. Preferred Maryland tobaccos are air cured, and often are referred to as light air cured tobaccos. Preferred air cured Maryland tobaccos are aged for at least one year after curing is complete.

The smokable material can be treated with tobacco additives of the type that are traditionally used for the manufacture of cigarettes, such as casing and/or top dressing components. See, for example, U.S. Pat. Nos. 3,419,015 to Wochnowski; 4,054,145 to Berndt et al.; 4,887,619 to Burcham, Jr. et al.; 5,022,416 to Watson; 5,103,842 to Strang et al.; and 5,711,320 to Martin. Typical casing materials include water, sugars and syrups (e.g., sucrose, glucose and high fructose corn syrup), humectants (e.g. glycerin or propylene glycol), flavoring agents (e.g., cocoa and licorice), and C3-C20 organic acids such as levulinic acid, pyruvic acid, and lacetic acid. Those added components also include top dressing materials (e.g., flavoring materials, such as menthol). See, for example, U.S. Pat. No. 4,449,541 to Mays et al. Additives also can be added to the smokable materials using the types of equipment described in U.S. Pat. No. 4,995,405 to Lettau, or equipment available as Menthol Application System (MAS) from Kohl Maschinenbau GmbH. The selection of particular casing and top dressing components is dependent upon factors such as the sensory characteristics that are desired, and the selection and use of those components will be readily apparent to those skilled in the art of cigarette design and manufacture. See, Gutcho, Tobacco Flavoring Substances and Methods, Noyes Data Corp. (1972) and Leffingwell et al., Tobacco Flavoring for Smoking Products (1972).

As noted above, the smokable material can include non-tobacco filler materials, and such materials preferably have general physical characteristics (e.g., size, shape, weight, density, and the like) that are similar to tobacco cut filler traditionally used for cigarette rod manufacture. The filler material may comprise paper, pulp, wood, plants, and mixtures thereof. The filler material may be woven or nonwoven, particulate, shredded, or granular.

Various tobacco substitute materials have been proposed. Substantial listings of various types of tobacco substitute materials can be found in U.S. Pat. Nos. 4,079,742 to Rainer et al. and 4,771,795 to White et al. Certain cigarette-type products that employ non-tobacco materials (e.g., dried vegetable leaves, such as lettuce leaves) as filler that is burned to produce smoke that resembles tobacco smoke have been marketed under the trade names "CUBEBS," "TRIUMPH," "JAZZ," and "BRAVO." For example, such materials are described in U.S. Pat. No. 4,700,727 to Torigian. Furthermore, tobacco substitute materials having the trade names "CYTREL" and "NSM" were introduced in Europe during the 1970s. Representative types of proposed synthetic tobacco substitute materials, smokable materials incorporating tobacco and other components, and cigarettes incorporating those materials, are described in British Pat. No. 1,431,045; and U.S. Pat. Nos. 3,738,374 to Bennett; 3,844,294 to Webster; 3,878,850 to Gibson et al.; 3,931,824 to Miano et al.; 3,943,941 to Boyd et al.; 4,044,777 to Boyd et al.; 4,233,993 to Miano et al.; 4,286,604 to Ehretsmann et al.; 4,326,544 to Hardwick et al.; 4,920,990 to Lawrence et al.; 5,046,514 to Bolt; 5,074,321 to Gentry et al.; 5,092,353 to Montoya et al.; 5,778,899 to Saito et al.; 6,397,852 to McAdam; and 6,408,856 to McAdam. Furthermore, various types of highly processed smokable materials incorporating tobacco and other ingredients are set forth in U.S. Pat. Nos. 4,823,817 to Luke; 4,874,000 to Tamol et al.; 4,977,908 to Luke; 5,072,744 to Luke et al.; 5,829,453 to White et al. and 6,182,670 to White et al.

Filter Element

Although the filter element 26 may vary in the present invention, certain embodiments utilized in the present invention comprise one or more segments of filter material capable of filtration of solid particles and/or vapor phase components of mainstream smoke generated during smoking of the cigarette 10. As shown in FIG. 2, the filter element 26 may include an adsorbent material 34 located within a central compartment 32 between two sections of filter material 36, 38. The first filter segment 36 and second filter segment 38 can include various types of filter material (e.g., cellulose acetate tow impregnated with plasticizer, such as triacetin). If desired, the filter element 26 also can be incorporate other components that have the ability to alter the properties of the mainstream smoke that passes throughout the filter element. See, for example, U.S. Pat. Application Publication Nos. 2004/0237984 to Figlar et al.; 2005/0066982 to Clark et al.; 2005/0268925 to Schluter et al.; 2006/0130861 to Luan et al.; and 2006/0174899 to Luan et al., which are incorporated herein by reference. Other filter element arrangements could be used without departing from the invention. For example, the adsorbent material 34 could be dispersed within one or more sections of filter material as opposed to placement in a central cavity or compartment.

As illustrated in FIG. 2, the filter element 26 typically comprises multiple, longitudinally-extending segments. Each segment can have varying properties and may include various materials capable of filtration or adsorption of particulate matter and/or vapor phase compounds. Typically, the filter element of the invention includes 1 to 6 segments, frequently 2 to 4 segments.

The filter material used in filter segments 36, 38 of the filter element 26 can vary, and can be any material of the type that can be employed as a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary or fibrous tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. Nos. 3,424,172 to Neurath; 4,811,745 to Cohen et al.; 4,925,602 to Hill et al.; 5,225,277 to Takegawa et al. and 5,271,419 to Arzonico et al.; each of which is incorporated herein by reference.

The particulate removal efficiency of each segment of filter material in the filter element can vary. For fibrous filter materials, particulate removal efficiency is preferably quantified in terms of weight per unit length of the filaments forming the fibers. Exemplary filter materials exhibit a filtration efficiency of about 1.8 to about 10 denier per filament. Each filter segment in a multi-segment filter element can have the same or different filtration efficiency. In one embodiment, the section of filter material 38 proximal to the tobacco rod 12 has a higher particulate removal efficiency than the section of filter material 36 distal from the tobacco rod. For example, the filaments of the tobacco end section of filter material 38 can have a lower weight per unit length than the filaments of the mouth end section of filter material 36. Exemplary filaments for use in the tobacco end section of filter material 38 have a weight per unit length of less than about 2.5 denier per filament, preferably about 1.8 to about 2.5. Exemplary filaments for use in the mouth end section of filter material 36 have a weight per unit length of greater than about 3.0 denier per filament, preferably about 3.0 to about 10.0.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

During draw, certain amount of certain gaseous components of the mainstream smoke are removed from the mainstream smoke by the adsorbent 34 within the filter element 26. Filters incorporating adsorbent materials, such as carbonaceous filter components (e.g., activated charcoal particles), have the capability of capturing a wide range of mainstream tobacco smoke vapor phase components. The adsorbent material 34 can be a material with relatively high surface area capable of adsorbing smoke constituents without a high degree of specificity, or a material that adsorbs certain compounds with a greater degree of specificity, such as an ion exchange resin. Exemplary types of adsorbent 34 include activated carbon, molecular sieves (e.g., zeolites and carbon molecular sieves), clays, ion exchange resins, activated aluminas, silica gels, meerschaum, and mixtures thereof. Any adsorbent material, or mixture of materials, that has the ability to alter the character or nature of mainstream smoke passing through the filter element could be used.

Typically, the amount of adsorbent within the filter element is at least about 20 mg, often at least about 30 mg, and frequently at least about 40 mg, on a dry weight basis. Typically, the amount of carbonaceous material or other adsorbent within the filter element does not exceed about 500 mg, generally does not exceed about 400 mg, often does not exceed about 300 mg, and frequently does not exceed about 200 mg, on a dry weight basis.

A preferred adsorbent 34 is a carbonaceous material, which is a material that is composed primarily of carbon, and preferred carbonaceous materials are composed of virtually all carbon. Typically carbonaceous materials comprise carbon in amounts of more than about 85 percent, generally more than about 90 percent, often more than about 95 percent, and frequently more than about 98 percent, by weight. The carbonaceous material can have the form of charcoal, but most preferably is an activated carbon material. Activated carbon materials are high surface area materials. Exemplary activated carbon materials have surface areas of more than about 200 $m^2/g$, often more than about 1000 $m^2/g$, and frequently more than about 1500 $m^2/g$, as determined using the Brunaver, Emmet and Teller (BET) method described in J. Amer. Chem. Soc., Vol. 60(2), pp. 309-319 (1938).

The carbonaceous material or other adsorbent of the filter element is employed in a suitable form. For example, the carbonaceous material or other adsorbent can have a form that can be characterized as powdered, granular, particulate form, or the like. Typical average particle sizes are greater than about 10 Mesh, often greater than about 20 Mesh, and frequently greater than about 30 Mesh. Typical particle sizes are less than about 400 Mesh, often less than about 300 Mesh, and frequently less than about 200 Mesh. The terms "granular" and "particulate" are intended to encompass both non-spherical shaped particles and spherical particles, such as so-called "beaded carbon" described in WO 03/059096 A1, which is incorporated by reference herein.

The carbonaceous materials can be derived from synthetic or natural sources. Materials such as rayon or nylon can be carbonized, followed by treatment with oxygen to provide activated carbonaceous materials. Materials such as wood and coconut shells can be carbonized, followed by treatment with oxygen to provide activated carbonaceous materials. The level of activity of the carbon may vary. Typically, the carbon has an activity of about 60 to about 150 Carbon Tetrachloride Activity (i.e., weight percent pickup of carbon tetrachloride). Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Examples of suitable carbonaceous materials are activated coconut hull based carbons available from Calgon Corp. as PCB and GRC-11 or from PICA as G277, coal-based carbons available from Calgon Corp. as S-Sorb, Sorbite, BPL, CRC-11F, FCA and SGL, wood-based carbons available from Westvaco as WV-B, SA-20 and BSA-20, carbonaceous materials available from Calgon Corp. as HMC, ASC/GR-1 and SC II, Witco Carbon No. 637, and AMBERSORB 572 or AMBERSORB 563 resins available from Rohm and Haas. Other carbonaceous materials are described in U.S. Pat. Nos. 4,771,795 to White, et al. and 5,027,837 to Clearman, et al.; and European Patent Application Nos. 236,922; 419,733 and 419,981.

Preferred carbonaceous materials are coconut shell types of activated carbons available from sources such as Calgon Carbon Corporation, Gowrishankar Chemicals, Carbon Activated Corp. and General Carbon Corp. See, also, for example, Activated Carbon Compendium, Marsh (Ed.) (2001), which is incorporated herein by reference.

Certain carbonaceous materials can be impregnated with substances, such as transition metals (e.g., silver, gold, copper, platinum, and palladium), potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the filter element 26 as a free radical scavenger.

Various types of charcoals and activated carbon materials suitable for incorporation into cigarette filters, various other filter element component materials, various types of cigarette filter element configurations and formats, and various manners and methods for incorporating carbonaceous materials into cigarette filter elements, are set forth in U.S. Pat. Nos. 2,881,770 to Touey; 3,101,723 to Seligman et al.; 3,217,715 to Berger et al.; 3,236,244 to Irby et al.; 3,311,519 to Touey et al.; 3,347,247 to Lloyd; 3,349,780 to Sublett et al.; 3,370,595 to Davis et al.; 3,413,982 to Sublett et al.; 3,602,231 to Dock; 3,648,711 to Berger et al.; 3,957,563 to Sexstone; 3,972,335 to Tigglebeck et al.; 4,174,720 to Hall; 4,201,234 to Neukomm; 4,223,597 to Lebert; 5,137,034 to Perfetti et al.; 5,360,023 to Blakley et al.; 5,568,819 to Gentry et al.; 5,622,190 to Arterbery et al.; 6,537,186 to Veluz; 6,584,979 to Xue et al.; 6,761,174 to Jupe et al.; 6,789,547 to Paine III; and 6,789,548 to Bereman; US Pat. Appl. Pub. Nos. 2002/0166563 to Jupe et al.; 2002/0020420 to Xue et al.; 2003/0200973 to Xue et al.; 2003/0154993 to Paine et al.; 2003/0168070 to Xue et al.; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2006/0144410 to Luan et al.; and 2006/0180164 to Paine, III et al.; U.S. patent application Ser. No. 11/226,932 to Coleman, III et al.; European Pat. Appl. 579410 to White; PCT WO 2006/051422 to Jupe et al.; and PCT WO 2006/064371 to Banerjea et al.; which are incorporated herein by reference. Representative types of cigarettes possessing filter elements incorporating carbonaceous materials have been available as "Benson & Hedges Multifilter" by Philip Morris Inc., in the State of Florida during 2005 as a Philip Morris Inc. test market brand known as "Marlboro Ultra Smooth," and as "Mild Seven" by Japan Tobacco Inc.

The carbonaceous material can be incorporated within a filter element by incorporating that carbonaceous material within paper or other sheet-like material (e.g., as a longitudinally disposed segment of gathered, shredded, or otherwise configured paper-like material). Alternatively, the carbonaceous material can be incorporated within a cavity as shown in FIG. 2 (e.g., a particles or granules within the central cavity region of a three-segment or stage filter element). Alternatively, the carbonaceous material can be dispersed within a fibrous filter material (e.g., as particles or granules dispersed throughout a filter tow or gathered non-woven web material) as a segment of a longitudinally multi-segmented filter element (e.g., a two-segment filter element).

Exemplary ion exchange resins comprises a polymer backbone, such as styrene-divinylbenzene (DVB) copolymers, acrylates, methacrylates, phenol formaldehyde condensates, and epichlorohydrin amine condensates, and a plurality of electrically charged functional groups attached to the polymer backbone, and can be a weak base anion exchange resin or a strong base anion exchange resin. Commercially available embodiments of such resins include DIAION® ion-exchange resins available from Mitsubishi Chemical Corp. (e.g., WA30 and DCA11), DUOLITE® ion exchange resins available from Rohm and Haas (e.g., DUOLITE® A7), and XORBEX resins available from Dalian Trico Chemical Co. of China.

If desired, suitable catalytic compounds, e.g., for the conversion of carbon monoxide to carbon dioxide, can be incorporated into one or more segments of the filter element 26. Exemplary catalysts include noble metals (e.g., silver, gold, platinum), metal oxides, ceramics, and mixtures thereof.

Method of Manufacturing Smoking Articles

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. Nos. 4,781,203 to La Hue; 4,844,100 to Holznagel; 5,131,416 to Gentry; 5,156,169 to Holmes et al.; 5,191,906 to Myracle, Jr. et al.; 6,647,870 to Blau et al.; 6,848,449 to Kitao et al.; and 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. Nos. 3,288,147 to Molins et al.; 3,915,176 to Heitmann et al.; 4,291,713 to Frank; 4,574,816 to Rudszinat; 4,736,754 to Heitmann et al. 4,878,506 to Pinck et al.; 5,060,665 to Heitmann; 5,012,823 to Keritsis et al. and 6,360,751 to Fagg et al.; and U.S. Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. Nos. 5,101,839 to Jakob et al.; 5,159,944 to Arzonico et al.; 5,220,930 to Gentry and 6,779,530 to Kraker; U.S. Patent Publication Nos. 2005/0016556 to Ashcraft et al.; 2005/0066986 to Nestor et al.; and 2005/0076929 to Fitzgerald et al.; and U.S. patent application Ser. Nos. 11/226,932, filed Sep. 14, 2005, to Coleman, III et al.; 11/375,700, filed Mar. 14, 2006, to Thomas et al. and 11/408,625, filed Apr. 21, 2006, to Oglesby; each of which is incorporated herein by reference. Most preferably, the entire smokable rod is composed of smokable material (e.g., tobacco cut filler) and a layer of circumscribing outer wrapping material.

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. Nos. 4,281,671 to Byrne; 4,862,905 to Green, Jr. et al.; 5,060,664 to Siems et al.; 5,387,285 to Rivers; and 7,074,170 to Lanier, Jr. et al. Other types of technologies for supplying filter materials to a filter rod-forming unit are set forth in U.S. Pat. Nos. 4,807,809 to Pryor et al. and 5,025,814 to Raker; which are incorporated herein by reference.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within or throughout cellulose acetate tow (e.g., a "dalmation" type of filter segment) at one end, and a second cylindrical segment that is produced from a filter rod produced essentially of plasticized cellulose acetate tow filter material at the other end. Filter elements also can have the form of so-called "patch filters" and possess segments incorporating carbonaceous materials and rupturable microencapsulated materials. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. Nos. 4,920,990 to Lawrence et al.; 5,012,829 to Thesing et al.; 5,025,814 to Raker; 5,074,320 to Jones et al.; 5,105,838 to White et al.; 5,271,419 to Arzonico et al.; 5,360,023 to Blakley et al.; 5,396,909 to Gentry et al.; and 5,718,250 to Banerjee et al.; U.S. Pat. Appl. Pub. Nos. 2002/0166563 to Jupe et al., 2004/0261807 to Dube et al.; 2005/0066981 to Crooks et al.; 2006/0090769 to Woodson; 2006/0124142 to Zhang et al.; 2006/0144412 to Mishra et al., and 2006/0157070 to Belcastro et al.; PCT Publication No. WO 03/009711 to Kim; PCT Publication No. WO 03/047836 to Xue et al.; and U.S. patent application Ser. No. 11/226,932, filed Sep. 14, 2005, to Coleman III, et al.; which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,281,670 to Heitmann et al.; 4,280,187 to Reuland et al.; 4,850,301 to Greene, Jr. et al.; and 6,229,115 to Vos et al.; and U.S. Patent Application Publication Nos. 2005/0103355 to Holmes, 2005/1094014 to Read, Jr., and 2006/0169295 to Draghetti, each of which is incorporated herein by reference.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cigarette comprising a rod of smokable material circumscribed by an outer wrapping material, wherein the smokable material comprises a blend of tobacco materials, wherein the blend comprises about 5 to about 10 percent by weight of a dark air-cured tobacco, based on the dry weight of the smokable material.

2. The cigarette of claim 1, wherein the dark air-cured tobacco is produced in Central America, Caribbean Basin, South America, India, Indonesia, Philippines, Canada, United States, or Africa.

3. The cigarette of claim 1, further comprising a filter element attached to one end of the rod of smokable material.

4. The cigarette of claim 3, wherein the filter element comprises an adsorbent material.

5. The cigarette of claim 4, wherein the adsorbent material is selected from the group consisting of activated carbon, molecular sieves, clays, ion exchange resins, activated aluminas, silica gels, meerschaum, and mixtures thereof.

6. The cigarette of claim 4, wherein the adsorbent comprises activated carbon.

7. The cigarette of claim 1, further comprising menthol incorporated into the cigarette as a flavorant.

8. The cigarette of claim 1, wherein the blend further comprises tobacco materials selected from the group consisting of flue-cured tobacco, burley tobacco, Oriental tobacco, Maryland tobacco, and mixtures thereof.

9. The cigarette of claim 1, wherein the smokable material comprises a blend of the dark air-cured tobacco with flue-cured tobacco, burley tobacco, and Oriental tobacco.

10. The cigarette of claim 1, wherein the smokable material comprises a blend of the dark air-cured tobacco with flue-cured tobacco in cut filler form, the flue-cured tobacco being present in an amount of at least about 80 percent by weight.

11. The cigarette of claim 1, wherein the smokable material comprises a blend of the dark air-cured tobacco with. Oriental tobacco in cut filler form, the Oriental tobacco being present in an amount of at least about 50 percent by weight.

12. The cigarette of claim 1, wherein the smokable material comprises no more than about 8 percent by weight of burley tobacco.

13. A cigarette comprising a rod of smokable material circumscribed by an outer wrapping material and a filter element comprising an adsorbent material attached to one end of the rod of smokable material, wherein the smokable material comprises about 5 to about 10 percent by weight of a dark air-cured tobacco, based on the dry weight of the smokable material, blended with additional tobacco materials selected from the group consisting of flue-cured tobacco, burley tobacco, Oriental tobacco, Maryland tobacco, and mixtures thereof.

14. The cigarette of claim 13, wherein the adsorbent material is selected from the group consisting of activated carbon, molecular sieves, clays, ion exchange resins, activated aluminas, silica gels, meerschaum, and mixtures thereof.

15. The cigarette of claim 13, wherein the adsorbent comprises activated carbon.

16. The cigarette of claim 13, wherein the smokable material comprises a blend of the dark air-cured tobacco with flue-cured tobacco in cut filler form, the flue-cured tobacco being present in an amount of at least about 80 percent by weight.

17. The cigarette of claim 13, wherein the smokable material comprises a blend of the dark air-cured tobacco with Oriental tobacco in cut filler form, the Oriental tobacco being present in an amount of at least about 50 percent by weight.

18. The cigarette of claim 13, wherein the smokable material comprises no more than about 8 percent by weight of burley tobacco.

19. A cigarette comprising a rod of smokable material circumscribed by an outer wrapping material and a filter element comprising an adsorbent material attached to one end of the rod of smokable material, wherein the smokable material comprises a blend of flue-cured tobacco, burley tobacco, and dark air-cured tobacco, wherein the flue-cured tobacco is present in an amount of at least about 45 percent by weight, based on the dry weight of the smokable material, the dark air-cured tobacco is present in an amount of about 5 to about 10 percent by weight, and the burley tobacco is present in an amount of no more than about 8 percent by weight.

* * * * *